US005570547A

United States Patent [19]

Webb et al.

[11] Patent Number: 5,570,547

[45] Date of Patent: Nov. 5, 1996

[54] GRAIN FEED TANK WITH SWINGING CAP

[75] Inventors: John C. Webb, Macclesfield; Robert B. Batchelor, Tarboro, both of N.C.

[73] Assignee: Long Manufacturing North Carolina, Inc., Tarboro, N.C.

[21] Appl. No.: 397,649

[22] Filed: Mar. 2, 1995

[51] Int. Cl.[6] ..... E05F 11/00

[52] U.S. Cl. ..... 52/194; 52/192; 49/279; 49/344; 49/357; 454/35; 220/262; 220/247

[58] Field of Search ..... 52/192–198, 200; 49/357, 254, 279, 344; 220/247, 262, 264; 248/151, 220.31, 147; 454/3, 35, 175

[56] References Cited

U.S. PATENT DOCUMENTS

| | | | |
|---|---|---|---|
| 222,939 | 12/1879 | Pardessus | 454/35 |
| 1,032,012 | 7/1912 | Martin . | |
| 1,415,816 | 5/1922 | Edwards . | |
| 1,732,400 | 11/1928 | Eaton . | |
| 2,281,740 | 5/1942 | Blickhan | 248/150 |
| 2,348,075 | 11/1944 | Larkin et al. . | |
| 2,363,474 | 11/1944 | Schlesinger | 248/154 |
| 3,201,075 | 8/1965 | Sievers | 248/147 |
| 3,208,706 | 9/1965 | Clark | 248/147 |
| 4,208,839 | 6/1980 | Candy, Sr. | 49/344 |
| 4,598,496 | 7/1986 | Van Daele | 49/357 |
| 4,744,183 | 5/1988 | Kruger | 52/192 |
| 4,747,244 | 5/1988 | Christianson | 52/192 |
| 5,218,784 | 6/1993 | Pollock | 49/279 |

*Primary Examiner*—Carl D. Friedman
*Assistant Examiner*—Winnie Yip
*Attorney, Agent, or Firm*—Dowell & Dowell

[57] ABSTRACT

An agricultural grain storage or feed tank including a body with a roof having an upper inlet opening is provided with a roof cap assembly which includes an elongated and vertically extending control rod which is vertically and pivotably movable with respect to the body of the tank whereby a cap connected to the control rod may be selectively moved remotely from the opening by raising the control rod and thereafter swinging the cap relative to the opening. The opening is reinforced by a reinforcing centering ring which is selectively mounted to the exterior of the roof of the tank and which includes a plurality of support rods on which the cap is normally seated so as to create an air passageway into the inlet opening. In the preferred embodiment, the body of the tank is corrugated and is supported by legs having corrugated sections which interfit with the body of the tank.

19 Claims, 5 Drawing Sheets

40
45
40
45
40
30
38
48
13
49
11
8
48
10
8
46
18
55
56
64
54
53
50
58
18
64

GRAIN FEED TANK WITH SWINGING CAP

BACKGROUND OF THE INVENTION

1. Field of the Invention

This invention is generally directed to agricultural grain feed and storage tanks or bins and more specifically to a swinging cap assembly and a cap support centering ring which reinforces the inlet opening into a tank whereby a post cap may be selectively pivoted away from the opening to allow filling of the tank after which the cap may be moved into seated engagement with the reinforcing ring in such a manner as to allow airflow into the tank.

2. History of the Related Art

Agriculture feed grains are normally stored within elevated storage tanks or bins. Such tanks are normally cylindrical in configuration having an upper conically shaped roof at the apex of which is formed an inlet opening. Such storage tanks are also provided with a lower section which is conically formed having a discharge opening at the lower apex thereof through which the grain may be distributed by selectively controlling a slide door or chute associated with the discharge opening.

The inlet openings into the storage tanks are conventionally closed by a lid or cap which is pivotably secured to the roof. In many tanks, the inlet opening is also further defined by a collar which is structured to permit airflow into the tank to thereby provide ventilation and air pressure equalization.

Grains are normally loaded into such conventional feed tanks utilizing agricultural conveyors which may either be mechanical or pneumatic. As the openings into the tanks are elevated a substantial distance above the vehicles from which grain is being conveyed, the lids or caps are frequently accidently damaged by the conveyors as they are maneuvered into a loading position. Once a cap has been damaged or displaced so that it cannot properly be reseated, the cap must be repaired or replaced. Further, replacement of a cap, if badly damaged, must be accomplished immediately to prevent the direct exposure of the grain within the tanks to inclement weather conditions. In many instances, the damage to the lids or caps are not confined to such structures alone and frequently the rings or areas adjacent the openings into the tanks are damaged requiring additional repairs.

In an effort to prevent damage to caps of storage and feed tanks, some caps have been designed which are spring loaded to yield somewhat if engaged by a loading conveyor. Unfortunately, such covers do not adequately prevent damage as the caps remain closely spaced relative to the openings and are easily engaged by the inadvertent maneuvering of loading conveyors.

Some examples of prior art structures are disclosed in U.S. Pat. No. 1,032,012 to Martin, U.S. Pat. No. 1,415,816 to Edwards, U.S. Pat. No. 1,732,400 to Eaton, U.S. Pat. No. 2,348,075 to Larkin et al., U.S. Pat. No. 4,208,839 to Candy, U.S. Pat. No. 4,598,496 to Daele, U.S. Pat. No. 4,744,183 to Kruger, U.S. Pat. No. 4,747,244 to Christianson and U.S. Pat. No. 5,218,784 to Pollack.

SUMMARY OF THE INVENTION

This invention is directed to an agricultural storage or feed tank of the type utilized to store and disperse grain wherein the tank includes an upper roof having an inlet opening formed therein which is reinforced with a reinforcing centering ring which is designed to be secured exteriorly of the roof and which is provided with a plurality of radially and downwardly sloping support rods which are configured to cooperatively support a lid or cap which is utilized to cover the inlet opening.

The cap of the present invention is connected to an elongated control rod which includes a first vertically extending portion having a lower end mounted at an operating level adjacent the bottom portion of the tank and an upper end which is integrally formed with a cantilevered portion having an outer end fixed to the cap. The lower end of the rod includes an operating handle which is seated within one or more slots defined by a guide plate. The plate preferably defines a first vertically extending slot in which the handle is seated when the roof cap is mounted to the support rods over the reinforcing ring to thereby cover the opening into the tank and a second vertical slot in which the handle is positioned after the rod is manually raised relative to the plate, pivoted with respect thereto, and subsequently brought into alignment with the second slot. Once the handle is situated within the second slot, the cap will have been pivoted or swung remotely from the inlet opening and the rod will retain the cap in spaced relationship to the opening to thereby prevent damage to the cap by accidental contact with a loading conveyor.

A primary object of the present invention to provide a roof cap assembly for use with grain storage or feed tanks which includes a roof cap which is mounted to a vertically extending control rod which is slidably and rotatably mounted with respect to a tank so as to permit the roof cap to be elevated and then pivoted or swung remotely with respect to an opening into the roof of the tank so as to allow access to the opening during periods when grain is being loaded so that the roof cap is remotely spaced and cannot be accidently damaged by conveyors and other loading equipment.

It is also an object of the present invention to provide a roof cap assembly for agricultural storage and feed tanks wherein the roof cap is positively retained in a first position covering an inlet opening into the roof of a tank in such as a manner as to create an air ventilation space between the roof and the roof cap and is also positively retained in a remote second position relative to the opening after being pivoted away therefrom to permit loading of grain into the tank.

It is yet a further object of the present invention to provide an agricultural storage or feed tank having an inlet opening in the roof portion thereof wherein the opening is reinforced by a reinforcing centering ring which is attached from the outer surface of the roof in an encircling relationship with respect to the opening therein and which includes a plurality of support rods on which a roof cap is selectively seated when in a first position in such a manner as to create an air flow space between the roof cap and the roof of the tank, It is another object of the present invention to provide a reinforcing centering ring and roof cap assembly which may be retrofitted to existing agricultural storage or feed tanks whereby the reinforcing ring may be secured to the outer surface of a roof in surrounding relationship to an inlet opening therethrough and wherein the roof cap assembly includes a roof cap which is mounted to a vertically extending control rod which is pivotally and vertically adjustably mounted relative to the tank whereby the roof cap may be placed in a first covering relationship with respect to the opening and seated on the reinforcing ring and thereafter pivoted remotely with respect to the opening to a second position to allow loading of grain into the tank, It is also an object of the present invention to provide a grain storage or feed tank which includes a corrugated body portion which is supported relative to the ground by a plurality of legs which include upper corrugated elements which are interfitted within the corrugations of the grain tank body so as to provide a reinforced support structure for elevating the body with respect to the ground,

DESCRIPTION OF THE PREFERRED EMBODIMENT

Figure 1:
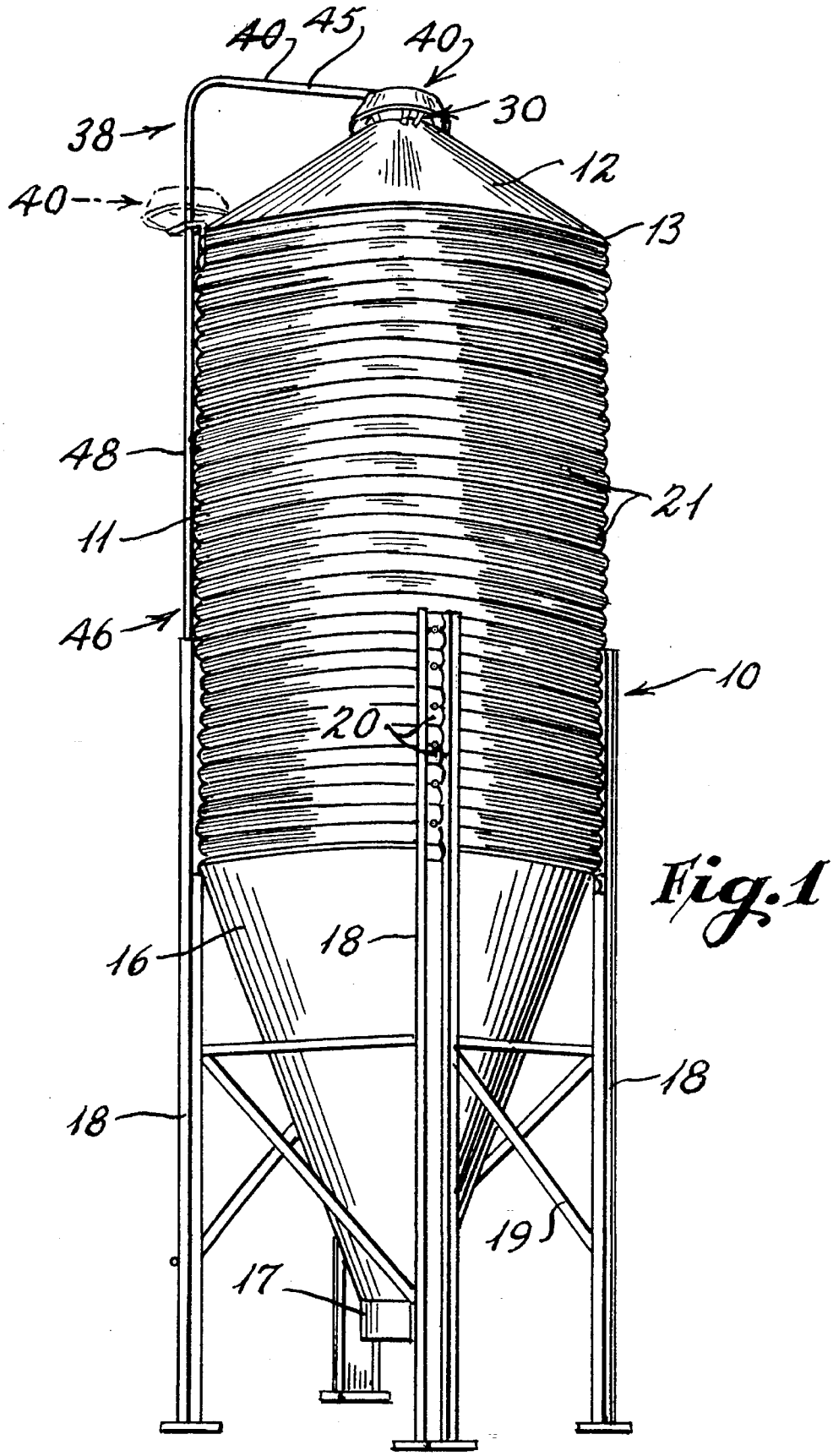
FIG. 1 is a perspective view of a grain storage or feed tank incorporating the roof cap assembly and reinforcing centering ring of the present invention showing the roof cap being seated over the opening into the tank in a solid line "closed" position and being swung away to permit loading through the opening in a dotted line fully "open" position.

With continued reference to drawing figures, the grain storage or feed tank 10 of the present invention includes a cylindrical body 11 which is formed of a corrugated aluminum, galvanized steel or similar material. The tank further includes a conical roof 12 which is sealed along the upper annular edge 13 of the body 11. An opening 14 is provided at the apex of the roof 12 for purposes of allowing grain to be deposited within the tank.

The lower portion 16 of the tank is also conically shaped terminating in a discharge chute 17 in which is mounted a closure assembly (not shown).

Figure 8:
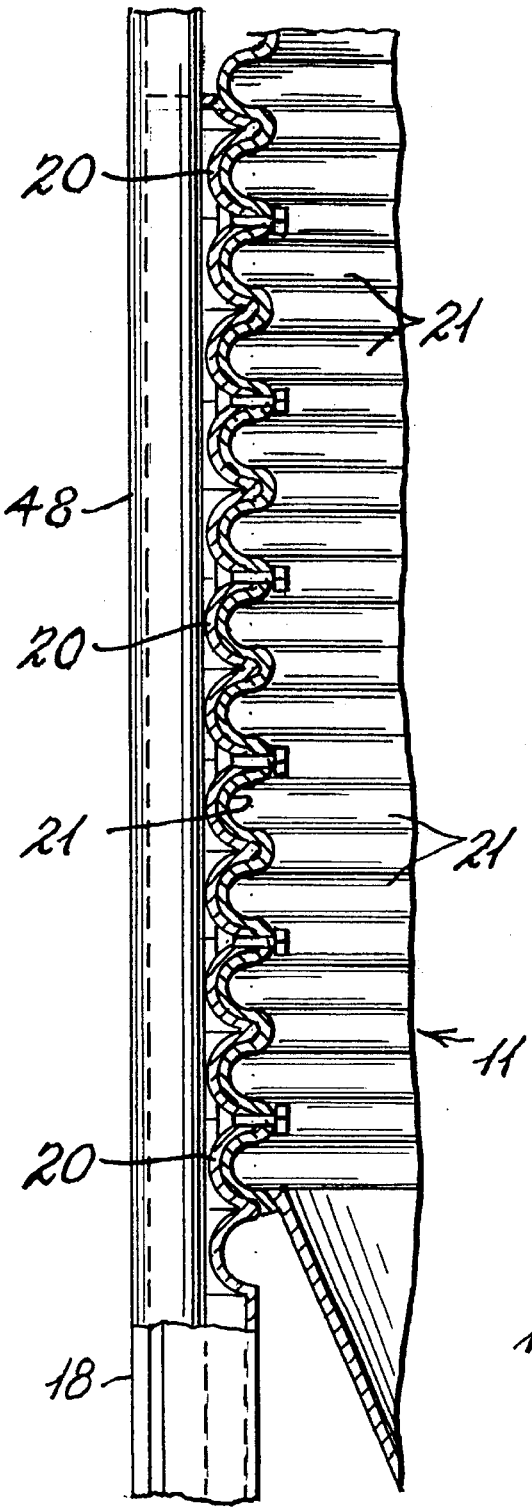
FIG. 8 is a vertical cross section along line 8—8 of FIG. 2.
Figure 9:
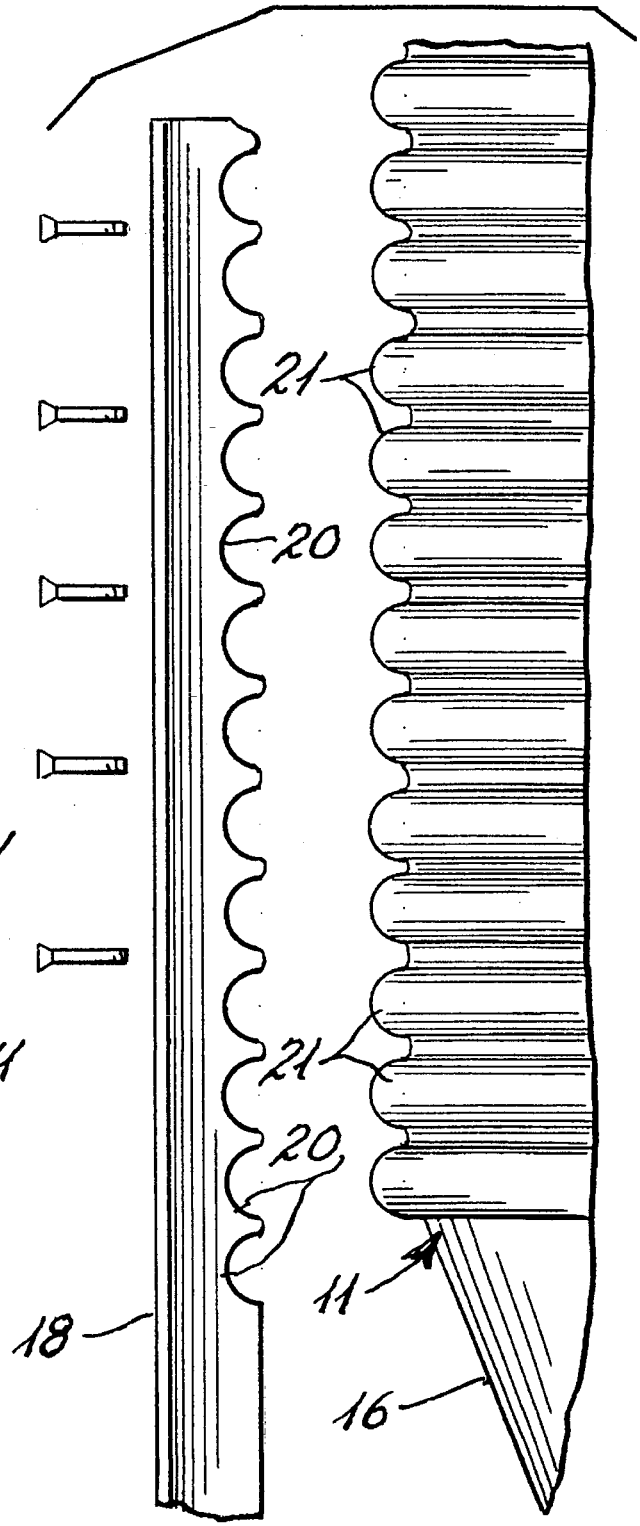
FIG. 9 is an exploded view of the leg and tank engagement of FIG. 8.

As shown in detail in FIGS. 8 and 9, the tank is mounted on a plurality of vertically extending reinforced metal legs 18 which are interconnected by cross bracing 19. The upper portion of each leg is corrugated as shown at 20 so as to interfit with the corrugations 21 of the body of the tank. In this manner, not only is the contact area between the upper portions of the legs and the corrugated body increased, but the corrugations of the legs form a plurality of horizontal supports which will function to alleviate any possibility of shearing of bolts or other fasteners which are utilized to connect the legs to the tank. The legs may be fastened by bolts or welded to the tank body.

Figure 4:
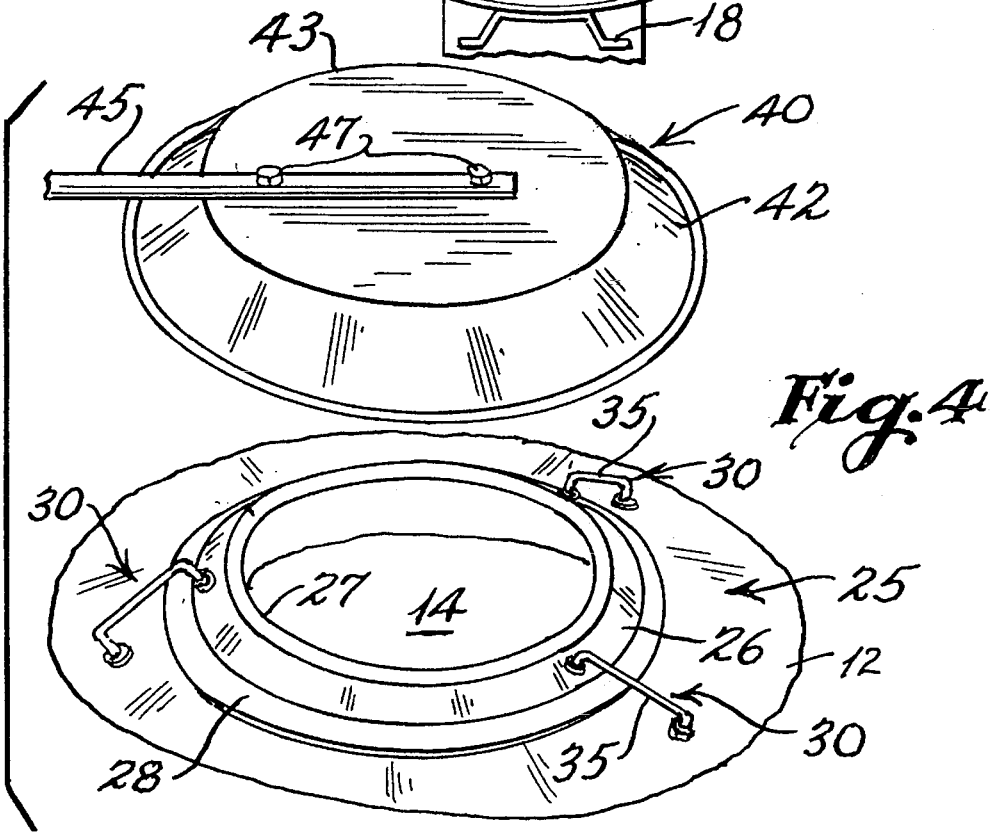
FIG. 4 is an assembly view of the roof cap and roof reinforcing centering ring of the present invention.
Figure 5:
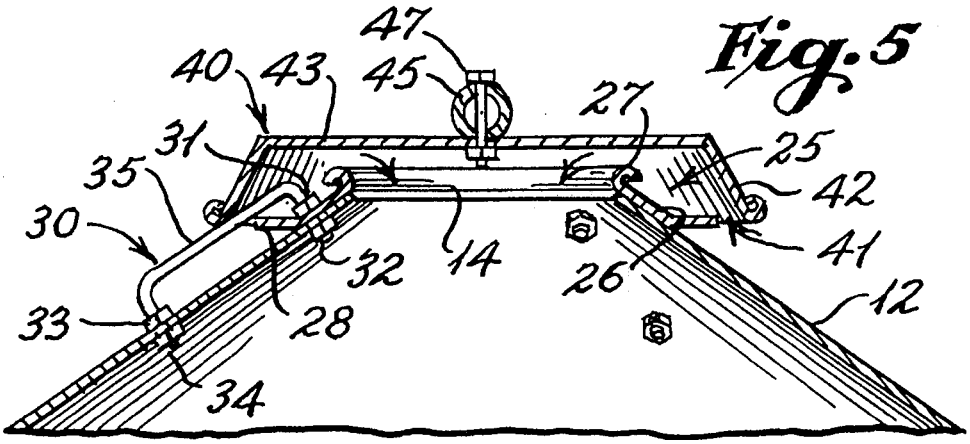
FIG. 5 is a cross-sectional view taken along line 5—5 of FIG. 3.
Figure 6:
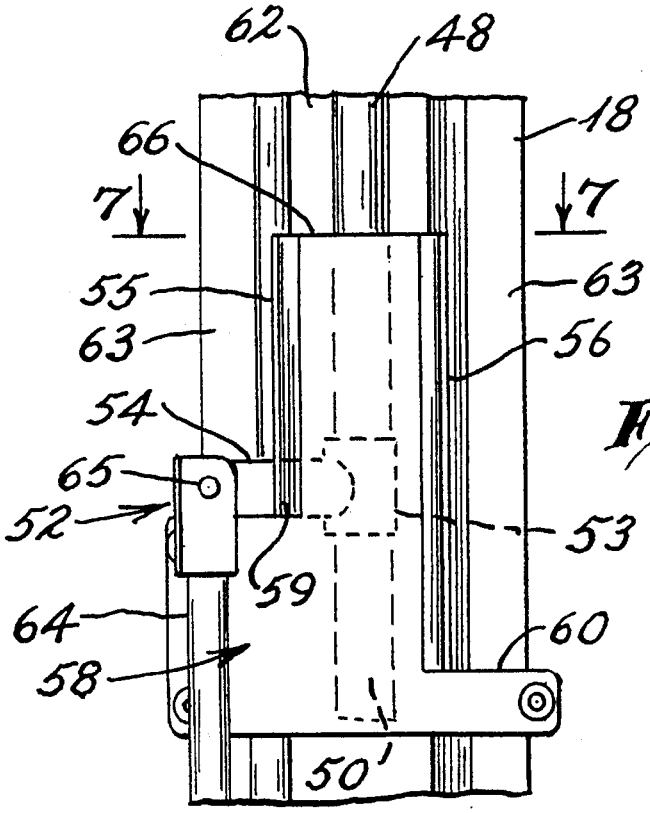
FIG. 6 is an enlarged view of the guide plate and handle for controlling the roof cap control rod of the present invention.
Figure 7:
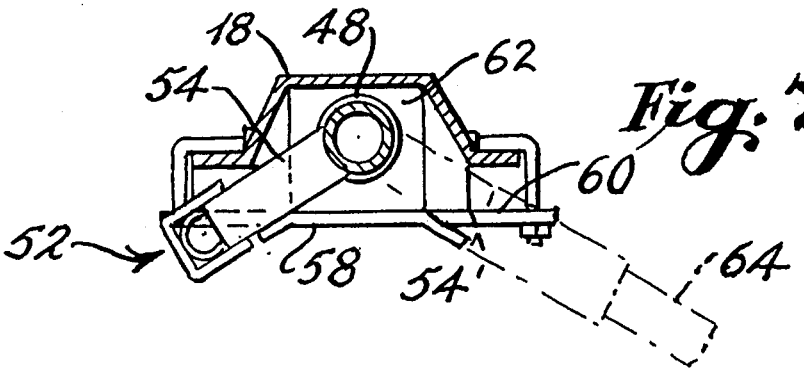
FIG. 7 is a cross-sectional view taken along line 7—7 of FIG. 6 showing the operating handle in dotted line in a position in which the roof cap is in a fully closed position and showing the handle in dotted line when the roof cap is fully opened.

With particular reference to FIGS. 4 and 5, the inlet opening 14 into the roof of the tank is reinforced by a reinforcing centering ring 25 which includes an annular conically configured side wall 26 which terminates at an upper reversely or outwardly curved annular truss 27 and a lower horizontally extending annular flange 28. The curved upper truss and the lower horizontal flange increase the compressive strength of the centering ring and thus reinforce the area of the roof adjacent the opening. Without the reinforcing ring being in place, it would be possible to easily damage the metal forming the area of the roof adjacent to the opening as material is loaded into the tank.

The reinforcing centering ring further includes a plurality of generally downwardly and radially extending support rods 30 having upper end portions 31 which are fastened through the annular conical side wall 26 of the centering ring by conventional fasteners such as bolts 32 and lower end portions 33 which are fastened by the use of bolts 34 or other fasteners to the roof. Each support rod is generally U-shaped in configuration and includes a central portion 35 which is spaced outwardly relative to the roof to thereby provide a support for a roof cap 40 of a roof cap assembly 38. As shown in FIG. 5, when the roof cap is seated on the support rods 30, an air space 41 is created between the centering ring and the roof cap to allow ventilation into the tank and to provide for air pressure equalization therein. The lower flange 28 of the centering ring cooperates with the depending portions 42 of the roof cap to ensure that rain cannot be driven by winds into the opening 14 of the tank. It should further be noted that the upper portion 43 of the roof cap is spaced relative to the curved truss 27 of the reinforcing ring 25 when the roof cap is seated on the support rods 30. Generally at least three supporting rods are provided, however, additional rods may be used depending upon design criteria.

The roof cap 40 is mounted to a cantilevered portion 45 of a control rod 46 of the roof cap assembly by way of conventional nut and bolt fasteners 47. In some instances, the roof cap may be welded to the cantilevered portion 45 of the control rod.

Figure 2:
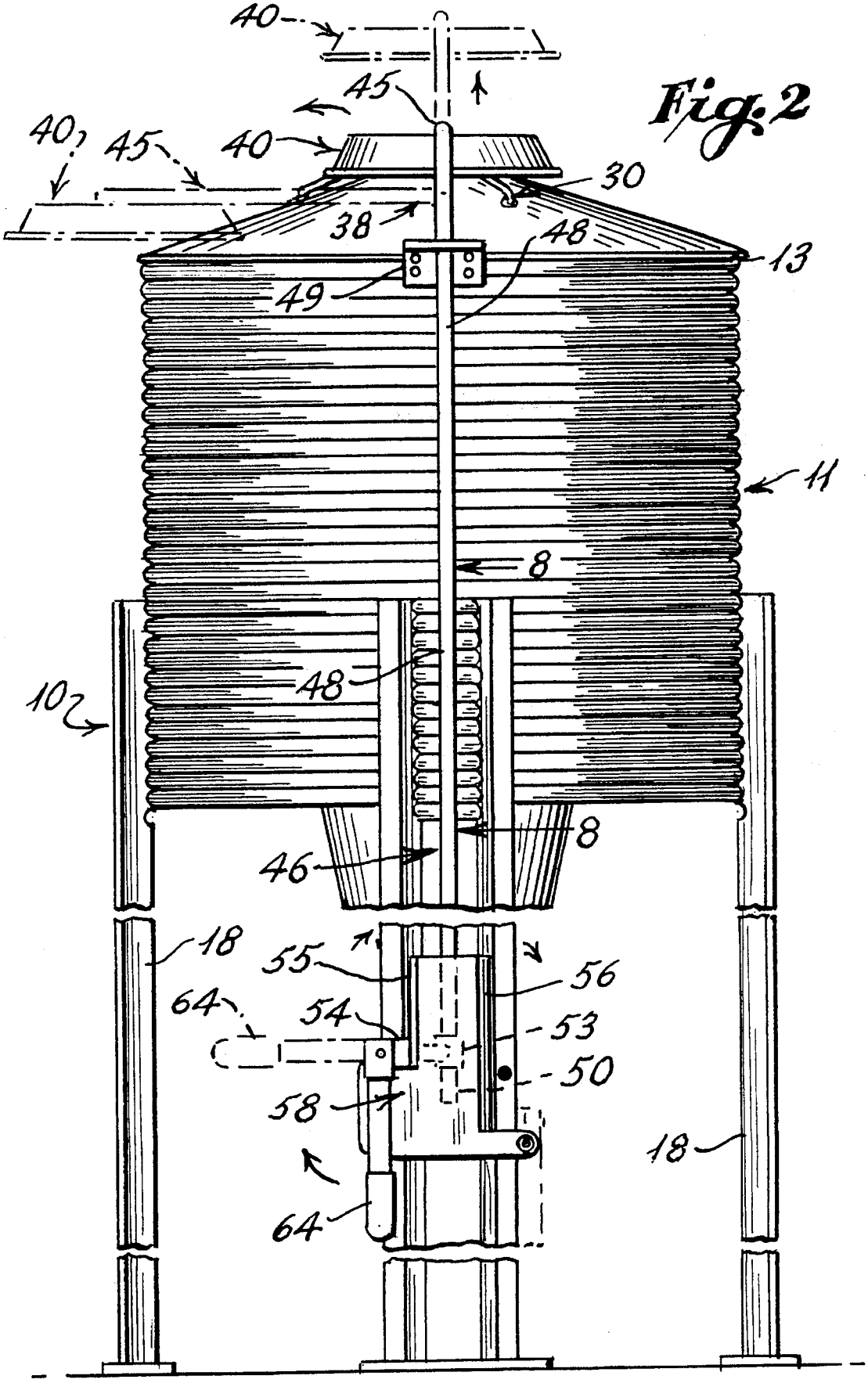
FIG. 2 is an enlarged front elevational view of the tank of the present invention showing the control rod assembly and guide plate for manipulating the roof cap of the present invention.
Figure 3:
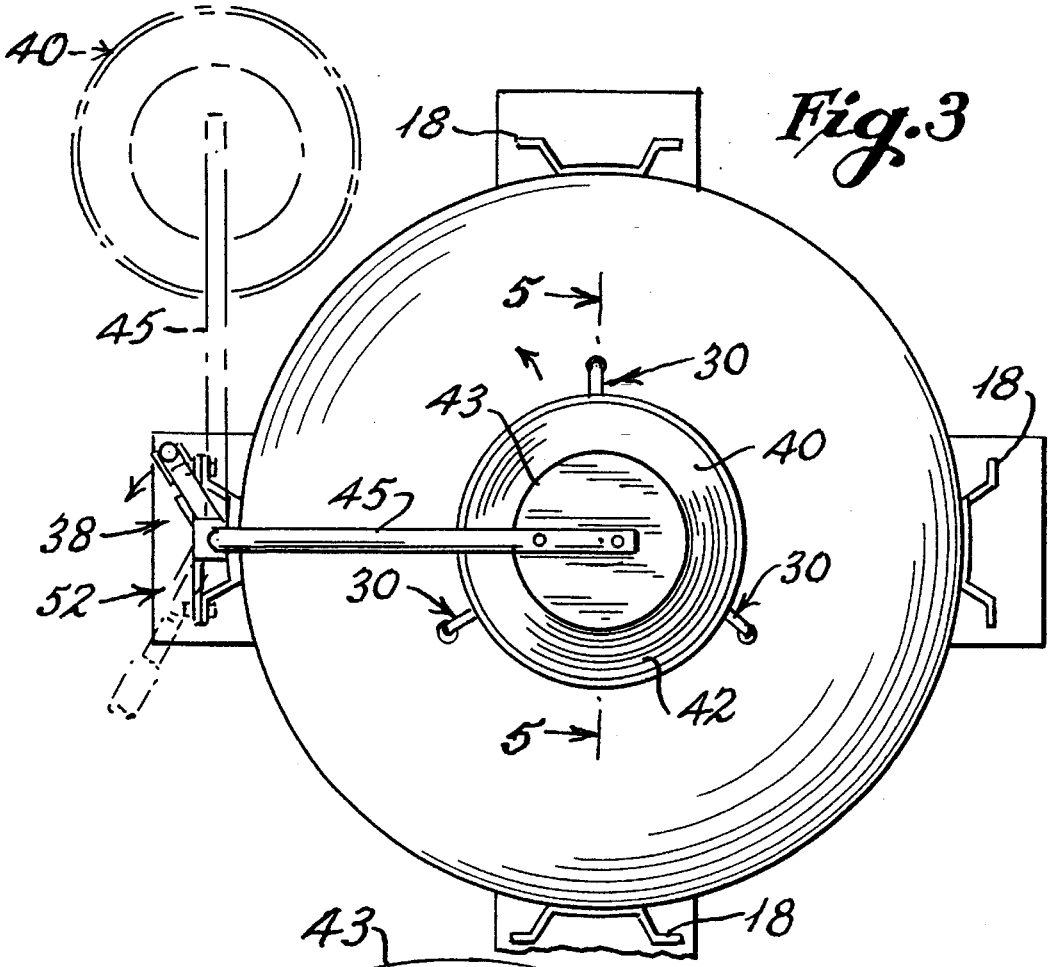
FIG. 3 is a top plan view of the tank of FIG. 2 showing the roof cap in the closed position in solid line and in the fully open position in dotted line.

As previously discussed, the control rod is mounted to the roof cap so as to enable the roof cap to be raised relative to the opening 14 and thereafter swung away and downwardly to a fully open position with respect to the opening as is shown in dotted line in FIGS. 1 through 3. In this position, the roof cap is safely retained at a point below the upper portion of the roof where the roof cap cannot be accidently damaged by elevating or discharge equipment which is utilized to supply grain through the opening into the tank. Any accidental contact between the loading equipment and the ring 25 is offset by the use of the reinforced curved annular truss 27 of the centering ring.

With specific reference to FIGS. 2, 3, 6, and 7, the use of the control rod 46 to maneuver the roof cap 40 is disclosed in greater detail. The control rod includes an elongated vertical section 48 which is guided through a guide sleeve 49 secured adjacent the upper rim 13 of the body 11 of the tank and terminates at a lower end 50 which is spaced upwardly from the lower portion of the legs at a distance of approximately 3 to 4 feet. Handle assembly 52 is mounted by a collar 53 adjacent to lower end 50 of the control rod and includes a fixed extension 54 which extends through a pair of spaced vertical slots 55 and 56 which are formed or defined between portions of the adjacent leg 18 and a guide assembly plate 58 which is secured by suitable fasteners or by welding across the open face of the leg. Slot 55 terminates at a first abutment edge 59 formed by one portion of the plate whereas slot 56 terminates against an abutment edge 60 of a second portion of the guide assembly plate. Both slots 55 and 56 are of the size to slidingly receive the extension 54 of the handle therein with the control rod 48 being positioned within a channel 62 formed between the outer edges 63 of the leg. The handle assembly 52 further includes a handle 64 which is pivotably mounted at 65 to the outer end portion of the extension 54.

As shown in FIG. 2, when the handle assembly is in a position so that the extension 54 thereof is mounted within slot 55 and engaged against the abutment surface 59 of the guide plate, the roof cap is in a closed or covering position seated on the support rods 30 of the reinforcing centering ring, as is shown in FIGS. 2 and 5. By pivoting the handle 64 outwardly and raising the handle assembly, the control rod 46 is elevated thereby elevating the roof cap 40 to a position, as shown in FIG. 4, in spaced relationship above the centering ring 25. In this position the extension 54 of the handle assembly is spaced above the upper edge 66 of the guide plate and thus is free of the slot 55. By rotating the handle assembly to the right, as shown in FIG. 2, the handle assembly is realigned with slot 56. In this position, the roof cap 40 is pivoted to the left, as shown in the dotted line in FIG. 2, after which the handle extension is lowered in the slot 56 to thereby lower control rod 48 to lower the roof cap to the dotted line open position, as shown in FIGS. 1 though 3. In the fully open position, the extension 54 of the handle assembly 52 will engage the abutment surface 60 of the guide plate and thereby retain the roof cap in the fully open position. As the handle is retained within the slot 56, it is not possible for the roof cap to be accidently moved from the open position.

Once grain has been loaded into the opening 14 into the tank, the handle assembly is raised to free it from the slot 56 after which the handle assembly is rotated to the left to thereby realign the handle with slot 55. In this position, the roof cap is immediately above the inlet opening. By lowering the handle extension through the slot 55, the cap will be lowered into appropriately seated engagement with the support rods 30 of the reinforcing ring assembly. The weight of the roof cap assembly 38 will ensure that the roof cap remains in place. Further, as the handle assembly 52 cannot be moved from the slot 55 without manually raising the handle relative to the guide plate, it is not possible to shift the roof cap once it has been seated.

Although not shown in the drawing figures, the guide plate may be formed in varying configurations. For instance, it may be possible to utilize a single slot such as slot 56 either between the plate and the adjacent edge of the leg or formed directly within the plate, without utilizing a separate slot for retaining the cap in a closed position. As opposed to utilizing the slot 55, a locking mechanism may be utilized to retain the handle in a raised position against the upper edge 66 of the guide plate so that the roof cap cannot be shifted after it has been raised without manually releasing the locking mechanism. As a further variation, a pair of protrusions could extend from the upper edge of the plate forming a small slot which would receive the extension portion of the handle when the handle is moved to position the roof cap on the support rods 38 in covering relationship with respect to the opening into the tank.

Although not shown in the drawing figures, in some instances, it may be desired to facilitate the manual operation of the control rod by providing a foot operated lever or pedal which would be interconnected by appropriate linkages to the lower end 50 of the control rod. In this manner, an operator could utilize the lever or foot pedal and by applying body weight to depress the pedal create a lifting force to simultaneous assist in raising of the control rod. The foot pedal would be utilized in conjunction with the handle thereby allowing the operator to more easily raise the control rod and thereafter utilize the handle to pivot the control rod so that the cap 40 is pivoted away from the inlet opening into the tank.

As a further modification, it is possible that a small motor could be used to provide the necessary vertical movement of the control rod. The motor could be connected by any appropriate means to the vertical portion of the control rod. By way of example, the motor may include a drive shaft having a toothed cogwheel mounted thereto which would engage within a toothed track mounted along the vertical portion of the control rod. By appropriate reversing of the rotational direction of the drive shaft, the control rod may be raised and lowered as desired. By appropriately bevelling the edges of the toothed track, the control rod may be rotated into and out of engagement relative to the drive cogwheel mounted to the drive shaft of the motor.

In view of the foregoing, it should be noted that there are numerous mechanical as well as manual mechanisms which may be utilized to lift and/or rotate the control rod to facilitate the pivotable movement of the cap relative to the inlet opening into the bin.

The roof cap and control rod assembly may be utilized to retrofit existing agricultural grain bins or tanks. In some instances, it may be necessary to specifically configure the roof cap 40 to be complementary to a specific opening. Also in some instances, it may be necessary to retrofit existing grain tanks to provide reinforcing centering ring assemblies as disclosed herein. As the reinforcing rings are designed to be installed from the outer surface of the roof, retrofitting existing structures is greatly facilitated.

We claim:

1. A roof cap assembly for use with an agricultural storage and feed tank wherein the tank includes a body having upper and lower portions and wherein the upper portion includes an inlet opening, the roof cap assembly comprising, a roof cap of a size to cover an the inlet opening when in a first position, a control rod having a vertically extending portion and a cantilevered portion, said cantilevered portion being connected to said roof cap, a handle assembly mounted to said vertical portion of said control rod and extending outwardly therefrom, and mounting means for mounting said control rod to a tank so that said cantilevered portion of said control rod and said roof cap are vertically moveable and horizontally swingable with respect to the inlet opening, whereby said handle assembly is engageable to raise said control rod to lift said roof cap relative to the inlet opening and thereafter is manipulable to rotate said control rod to swing said roof cap horizontally laterally relative to the inlet opening to a second position horizontally spaced from said first position to permit access to the inlet opening.

2. The roof cap assembly of claim 1 in which said mounting means for mounting includes a guide means adapted to be mounted to a body of a tank, said vertical portion of said control rod extending through said guide means.

3. The roof cap assembly of claim 2 further including a guide plate adapted to be connected to a tank, said guide plate defining at least one vertical slot in which said handle assembly is selectively slidingly received when said roof cap is in said second position.

4. The roof cap assembly of claim 3 in which said guide plate defines a second vertical slot in which said handle assembly is slidably disposed when said roof cap is in said first position.

5. An agricultural storage and feed tank comprising, a body having upper and lower portions and wherein said upper portion includes a roof having an inlet opening, a roof cap assembly including a roof cap of a size to cover said inlet opening when in a first position relative thereto and a control rod having a vertically extending portion and a cantilevered portion, said cantilevered portion being connected to said roof cap, a handle mounted to said vertical portion of said control rod and extending outwardly therefrom, mounting means for mounting said control rod to said body of the tank so as said control rod and cap are vertically moveable and horizontally rotatable with respect to the inlet opening so that said handle assembly is engageable to raise said control rod to lift said roof cad relative to said inlet opening and thereafter manipulated to rotate said control rod to swing said roof cap laterally relative to said inlet opening to a second position to permit access to said inlet opening, said mounting means for mounting including a guide means mounted to said body of the tank, said vertical portion of said control rod extending through said guide means, a guide plate connected to the tank, said guide plate defining at least one vertical slot in which said handle assembly is slidingly received when said roof cap is in said second position, said guide plate defining a second vertical slot in which said handle assembly is slidably disposed when said roof cap is in said first position, a plurality of support rods mounted to said roof and extending radially outwardly relative to said inlet opening therein, each of said support rods having a portion which is spaced from said roof, and means for mounting said support rods to said roof whereby when said roof cap is seated on said support rods, said roof cap is in spaced relationship with respect to said roof and a ventilation air space is created therebetween.

6. The argicultural storage and feed tank of claim 5 further including a reinforcing centering ring having an annular side wall having upper and lower portions, an annular flange extending outwardly from said lower portion of said side wall, an upper curved annular flange extending outwardly from said upper portion of said side walls and said reinforcing centering ring being of a size to engage said roof in surrounding relationship with respect to said inlet opening.

7. The agricultural storage and feed tank of claim 6 in which said roof cap includes a depending side wall having a lower edge portion, said lower edge portion normally engaging said support rods in said first position so as to be in spaced relationship with respect to said annular flange of said reinforcing centering ring so that said roof cap is spaced with respect to said curved annular flange of said reinforcing centering ring.

8. An agricultural grain tank comprising a body having upper and lower ends, a roof mounted to said upper end of said body, a discharge chute mounted to said lower portion of said body, an inlet opening to said body in said roof, a roof cap assembly including a cap of a size to cover said inlet opening into said body and a control rod, said control rod having a cantilevered portion connected to said cap and a vertical portion, means for guidingly mounting and controlling said vertical portion of said control rod to said body of the tank so that said control rod is vertically raised and horizontally rotated relative to said body to thereby raise said cap and horizontally swing said cap away from a first position covering said inlet opening to a second position entirely spaced from said inlet opening.

9. The agricultural grain tank of claim 8 further including a handle means mounted to said vertical portion of said control rod, and a guide plate means mounted relative to said body portion of the tank, said guide plate defining at least one vertical slot in which said handle means is slidably engageable when said cap is in said second position relative to said inlet opening.

10. The agricultural grain tank of claim 9 in which said guide plate means defines a second vertical slot in which said handle means is slidably deposed when said cap is in said first position.

11. The agricultural grain tank of claim 10 including a plurality of legs, at least one of said legs having a vertically extending recessed portion, said vertical portion of said control rod extending within said recessed portion of said at least one leg, and means for securing said guide plate means to said at least one of said legs in covering relationship to said recessed portion thereof so that said vertical portion of said control rod extends between said at least one of said legs and said guide plate means.

12. The agricultural grain tank of claim 11 in which said first and second slots are formed between opposite sides of said guide plate and said at least one of said legs.

13. The agricultural grain tank of claim 11 in which said body is formed having a plurality of generally horizontal corrugations, each of said legs having an upper portion having corrugations, said corrugations of each of said legs being mounted in interfitted relationship with respect to said corrugations of said body.

14. The agricultural grain tank of claim 8 including a plurality of support rods mounted to said roof and extending radially outwardly relative to the inlet opening therein, each of said support rods having a portion which is spaced from the roof, and means for mounting said support rods to the roof whereby when the cap is seated on said support rods in spaced relationship with respect to the roof, a ventilation air space is created therebetween.

15. The agricultural grain tank of claim 14 including a reinforcing centering ring having an annular side wall having upper and lower portions, an annular flange extending outwardly from said lower portion of said side wall, an upper curved annular flange extending outwardly from said upper portion of said side wall, and said reinforcing centering ring being of a size to engage said roof in surrounding relationship with respect to the inlet opening.

16. The agricultural grain tank of claim 15 in which said cap includes a depending side wall having a lower edge portion, said lower edge portion normally engaging said support rods in said first position so as to be in spaced relationship with respect to said annular flange of said reinforcing centering ring so that said cap is spaced with respect to said curved annular flange of said reinforcing centering ring.

17. The agricultural grain tank of claim 16 including a plurality of legs, at least one of said legs having a vertically extending recessed portion, said vertical portion of said control rod extending within said recessed portion of said at least one of said legs, and means for securing said guide plate means to said at least one of said legs in covering relationship to said recessed portion thereof so that said vertical portion of said control rod extends between said at least one of said legs and said guide plate means.

18. The agricultural grain tank of claim 8 in which said body is formed having a plurality of generally horizontal corrugations, a plurality of legs each having an upper portion having corrugation associated therewith, said corrugation of each of said legs being mounted in interfitted relationship with respect to said corrugations of said body.

19. A roof cap assembly for use with an agricultural storage and feed tank wherein the tank includes a body having upper and lower portions and wherein the upper portion includes an inlet opening, the roof cap assembly comprising, a roof cap of a size to cover the inlet opening when in a first position relative thereto, a control rod having a vertically extending portion and a cantilevered portion, said cantilevered portion being connected to said roof cap, control means for vertically raising and rotating said control rod, mounting said control rod to the tank so that said cantilevered portion and said roof cap are vertically and horizontally moveable with respect to the inlet opening whereby said roof cap is raised relative to the inlet opening and thereafter swung laterally relative to the inlet opening to a position to permit access to the inlet opening.

* * * * *